US006189243B1

(12) United States Patent
Oikawa

(10) Patent No.: US 6,189,243 B1
(45) Date of Patent: Feb. 20, 2001

(54) DREDGING METHOD AND DREDGING APPARATUS

(75) Inventor: Senji Oikawa, Matsumoto (JP)

(73) Assignee: Moburon Design Office Co., Ltd., Nagano (JP)

( * ) Notice: Under 35 U.S.C. 154(b), the term of this patent shall be extended for 0 days.

(21) Appl. No.: 09/297,325

(22) PCT Filed: Oct. 27, 1997

(86) PCT No.: PCT/JP97/03889

§ 371 Date: Apr. 29, 1999

§ 102(e) Date: Apr. 29, 1999

(87) PCT Pub. No.: WO98/20208

PCT Pub. Date: May 14, 1998

(30) Foreign Application Priority Data

Nov. 2, 1996 (JP) ..... 8-327482

(51) Int. Cl.[7] ..... E02F 3/88
(52) U.S. Cl. ..... 37/317; 37/195
(58) Field of Search ..... 37/317, 320, 321, 37/322, 323, 324, 335, 344, 345, 195

(56) References Cited

U.S. PATENT DOCUMENTS 3,815,267 * 6/1974 Laarman ..... 37/317
4,030,216 * 6/1977 Willums ..... 37/320
4,253,255 * 3/1981 Durell ..... 37/322
4,307,525 * 12/1981 Maloblocki ..... 37/320
4,353,174 * 10/1982 Maloblocki ..... 37/317
4,391,468 * 7/1983 Funk ..... 299/8

FOREIGN PATENT DOCUMENTS 62-284831 12/1987 (JP) .
1207535 8/1989 (JP) .
3151421 6/1991 (JP) .

* cited by examiner

*Primary Examiner*—Robert E. Pezzuto

(57) ABSTRACT

A dredging method and a dredging apparatus which can efficiently suck large quantities of sand and gravels deposited on the bottom of dams, rivers, harbors, etc., convey them with as much saved energy as possible, and can prevent diffusion of turbid water. To achieve these objects, the apparatus includes a case laid down into the water in communication with the atmosphere. A suction pipe having a suction portion at the lower end thereof is connected to this case. The apparatus further includes a drain pump for draining water in the case and forming a level difference between the water level in the case and the external water level A container is removably disposed at an intermediate portion of the suction pipe. The sand and gravels are sucked from the suction pipe into the container by the siphon principle due to the level difference between the external water level and the water level in the container, and the container is cut off and the sand and gravels are taken out when the container is full.

20 Claims, 7 Drawing Sheets

DREDGING METHOD AND DREDGING APPARATUS

This application is the national phase under 35 U.S.C. §371 of PCT International Application No. PCT/JP97/03889 which has an International filing date of Oct. 27, 1997 which designated the United States of America.

FIELD OF TECHNOLOGY

The present invention relates to a method of dredging and a dredging apparatus which can efficiently dredge large quantities of sand and gravels, deposited on the bottom of dams, rivers, harbours, etc.

BACKGROUND TECHNOLOGY

Recently, 80% or more of the capacities of some dams are filled with sand and gravels, thereby reducing dam operability and effectiveness.

To recover their function, an effective dredging method and an effective dredging apparatus are required.

Conventionally, sand and gravel deposites are removed by methods employing a dipper, a crab, a bucket, a pump or a siphon, which are selected according to the deposit condition of the sand and gravels.

TECHNICAL PROBLEMS

The conventional dredging methods have the following problems.

In the conventional methods not employing a siphon, a great power is required, so the dredging apparatus must be large and heavy. Further a large amount of turbid water, which is generated when the sand and gravels are dredged, remains untreated.

In the conventional methods employing a sand pump and the siphon, there is a problem of conveying a mingled fluid (a fluid including sand, gravels and a liquid). Namely, fluid resistance of the mingled fluid in a pipe is great, so energy consumption is also great. Thus, size of gravels conveyed is usually limited to about 5 mm, and it is therefore difficult to dredge gravels larger in size.

In the conventional method employing the siphon, a large amount of water (about 80% of capacity) is drained, so that the turbid water is also drained without treatment. In the case of employing the siphon, attention must be paid to the percentage of sand and gravels in water. If a suction pipe is set too close to the bottom of a boy of water, said percentage is rapidly increased, fluid speed is reduced, and the suction pipe is filled with the sand and gravels. On the other hand, if a suction pipe is set too far from the bottom of the water, the siphon sucks the water only, dredging efficiency is lowered lower, and a large amount of turbid water is generated. Therefore, in the case of employing the siphon, a distance between an inlet of the suction pipe and the bottom of the water should be fixed, but it has been a technical problem.

DISCLOSURE OF THE INVENTION

An object of the present invention is to provide a dredging method and a dredging apparatus which can efficiently suck large quantities of sand and gravel deposited on the bottom of water, convey them while conserving as much energy as possible and can prevent diffusion of turbid water.

Namely, the method of dredging sand and gravels in a dredging apparatus includes: a case being laid down into water in communication with the atmosphere; a suction pipe having a suction portion at the lower end thereof, the suction pipe being connected to the case; and a drain pump for draining water in the case, and the method comprises the steps of: draining water in the case so as to form a space therein and to form a level difference between the water level in the case and the external water level; and sucking the sand and gravels from the suction pipe by the water current caused by the level difference.

In the method, sand and gravels can be properly dredged by: sucking them into the case via the suction pipe; and conveying the sand and gravels deposited in the case to the outside by a belt conveyor.

Further, in the method, sand and gravels can be properly dredged by sucking them into a container, which is removably disposed at an intermediate portion of the suction pipe.

The dredging apparatus of the present invention comprises: a case being laid down into the water in communication with the atmosphere; a suction pipe having a suction portion at the lower end thereof, the suction pipe being connected to the case; and a drain pump for draining water in the case and forming a level difference between the water level in the case and the external water level.

Preferably, the apparatus has a belt conveyor extending into the case so as to convey the sand and gravels deposited in the case.

Preferably, the case has a pocket portion at a lower part thereof, the suction pipe is connected to the pocket portion, and a guide plate, which is capable of guiding the sand and gravels sucked through the suction pipe sideward, is provided in the pocket portion.

Preferably, an upper end of the pipe is pivotably attached to a dredging boat, a first float communicating with the atmosphere is provided to the case, and the dredging apparatus further comprises a first pump for supplying water into and draining water from the first float so as to adjust buoyant forces of the first float.

Further preferably, a second float communicating with the atmosphere is provided to the suction pipe, and the dredging apparatus further comprises a second pump for supplying water into and draining water from the second float so as to adjust buoyant forces of the second float.

In the apparatus, a container, into which sand and gravels are introduced via the suction pipe, may be removably disposed at an intermediate portion of the suction pipe.

Preferably, in this case, a third float communicating with the atmosphere is provided to the container, and the dredging apparatus further comprises a third pump for supplying water into and draining water from the third float so as to adjust buoyant forces of the third float.

In the apparatus, a dome-shaped cover may be provided to the lower end of the suction pipe so as to cover over the suction portion thereof.

The apparatus may further comprise a contact plate having a suction hole and being provided to the suction pipe so as to cover over a lower part of the suction portion.

In this case, the contact plate preferably has a pile-shaped projection capable of piercing the bottom of the water.

Further, in this case, a vibrator for vibrating the contact plate is preferably provided.

In the dredging apparatus, the contact plate may be rotated, about an axis of the suction pipe, by a motor.

Further, the dredging apparatus may further comprise a precipitation tank in which turbid water drained from the case by the drain pump is reservoired.

In this case, the dredging apparatus may further comprise a circulation pump for spouting the water reservoired in the precipitation tank into the dome-shaped cover.

EMBODIMENTS

Preferred embodiments of the present invention will now be described in detail with reference to the accompanying drawings, but the present invention is not limited to the following embodiments, modifications are allowed without deviating from the spirit of the present invention, allowable modifications are, of course, included within the scope of the present invention.

First Embodiment

Figure 1:
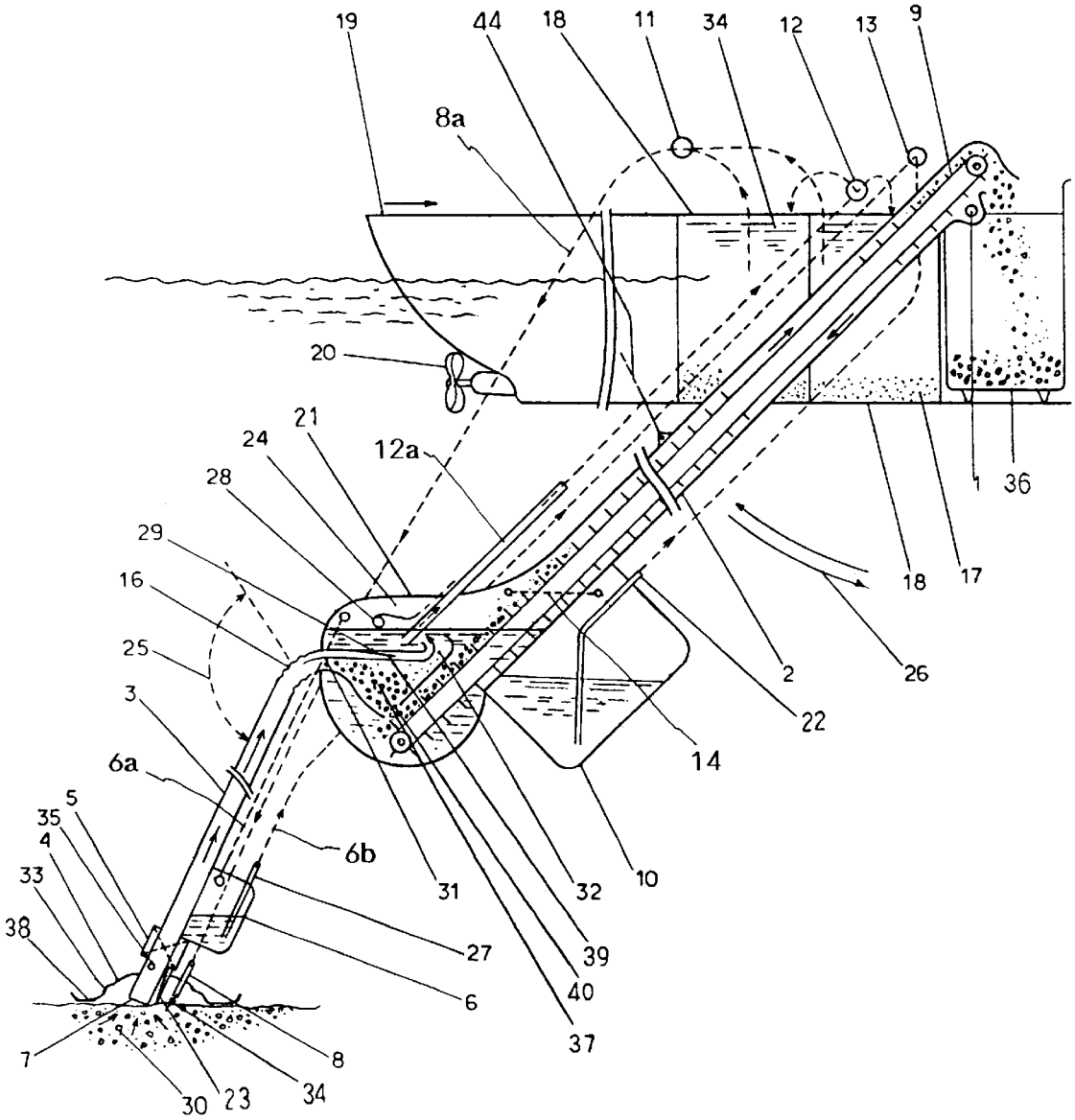
FIG. 1 is a side explanation view showing an outline of a First Embodiment.
Figure 2:
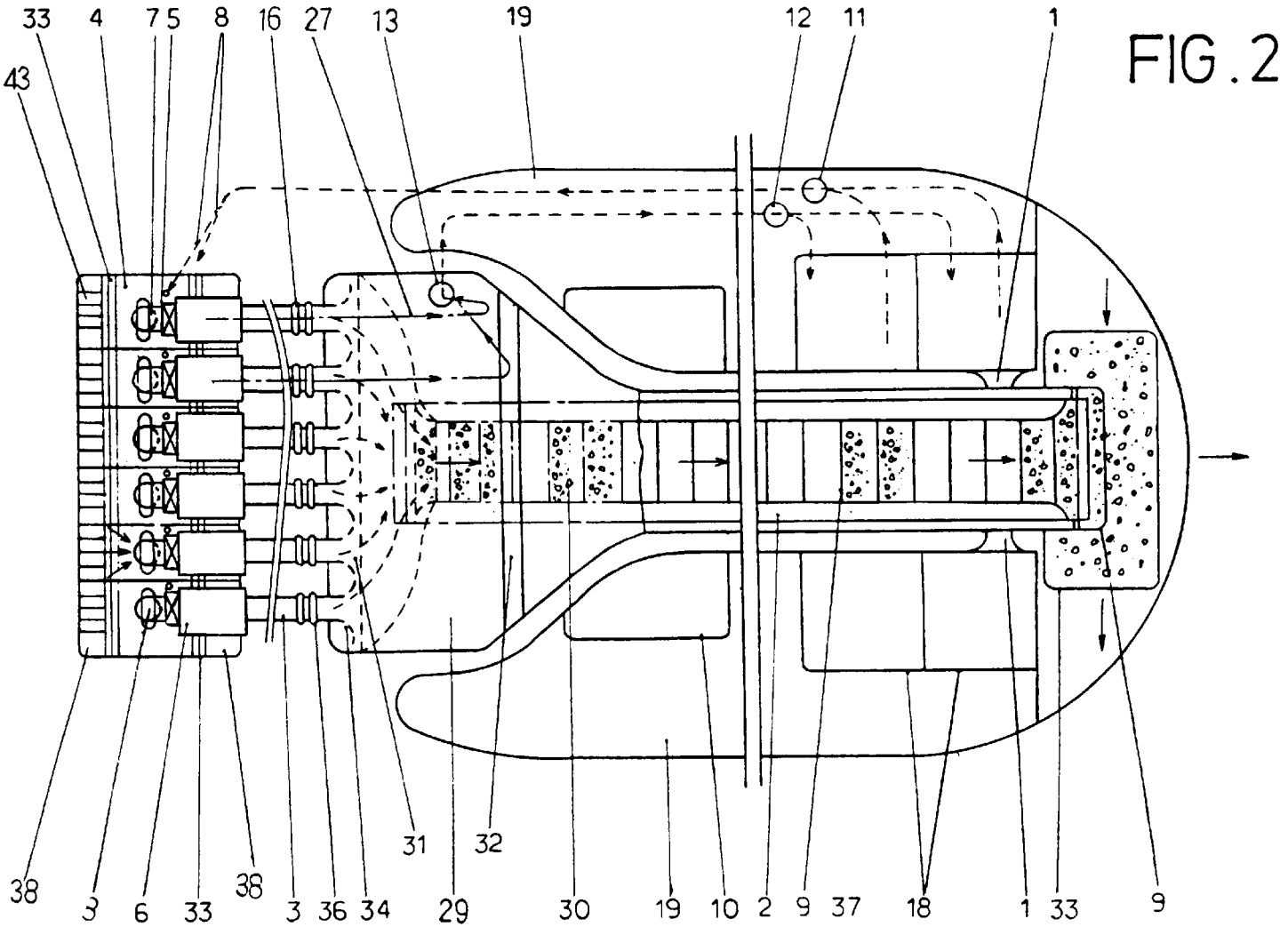
FIG. 2 is a plan view of the First Embodiment.
Figure 3:
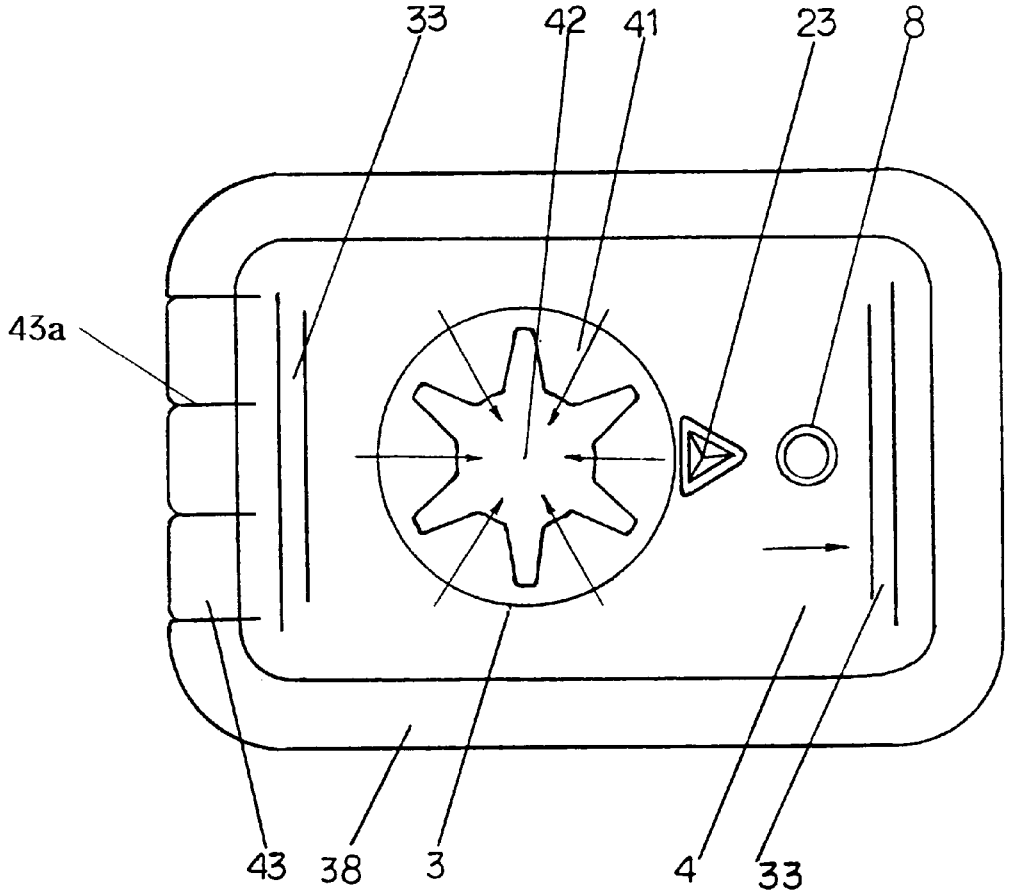
FIG. 3 is a bottom view of a cover.
Figure 4:
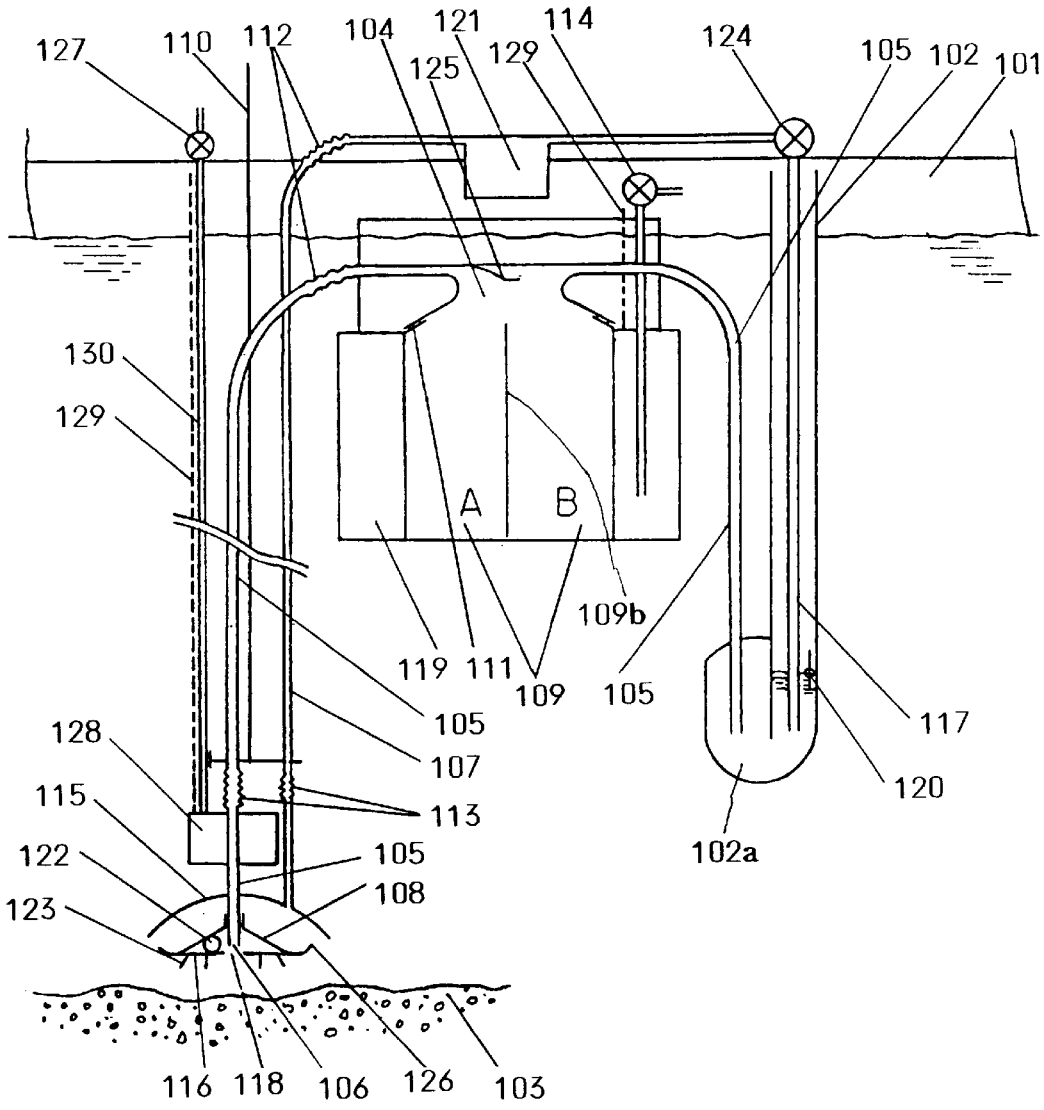
FIG. 4 is a side explanation view showing an outline of a Second Embodiment.
Figure 5:
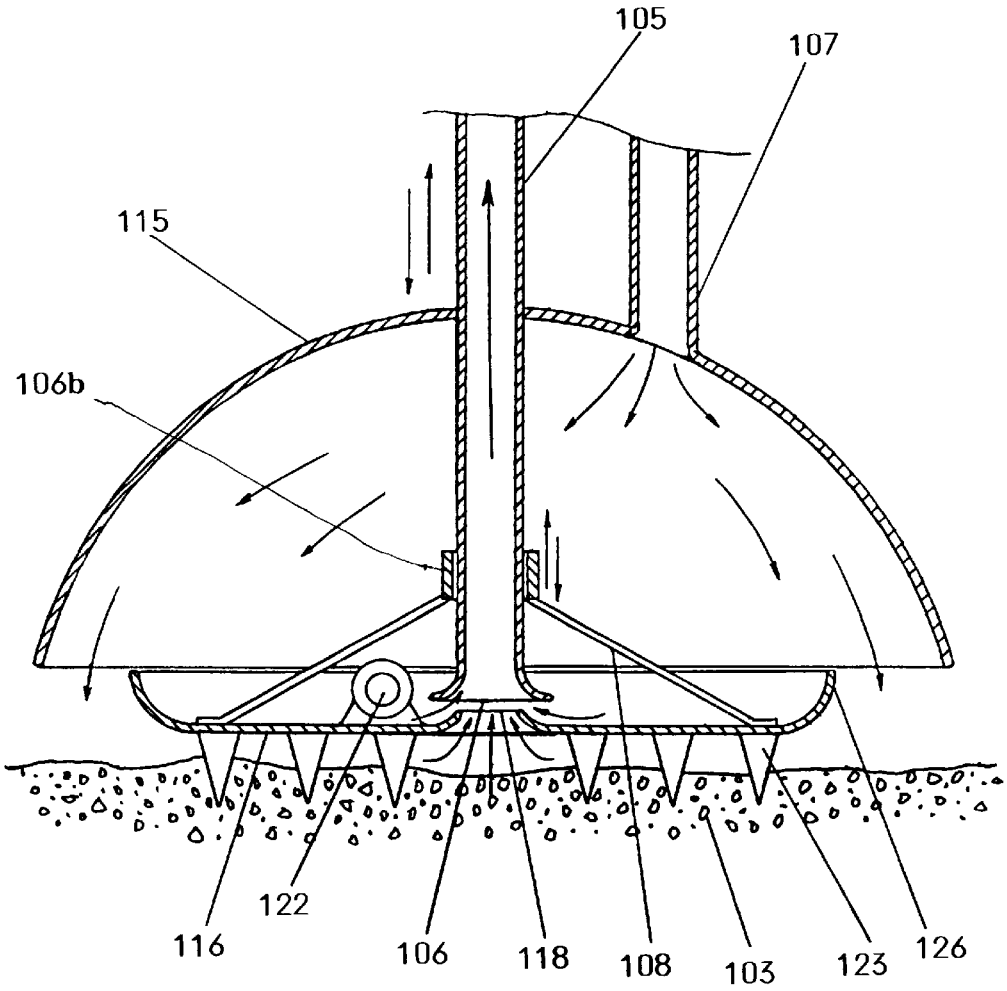
FIG. 5 is a sectional explanation view of the cover and a contact plate.
Figure 6:
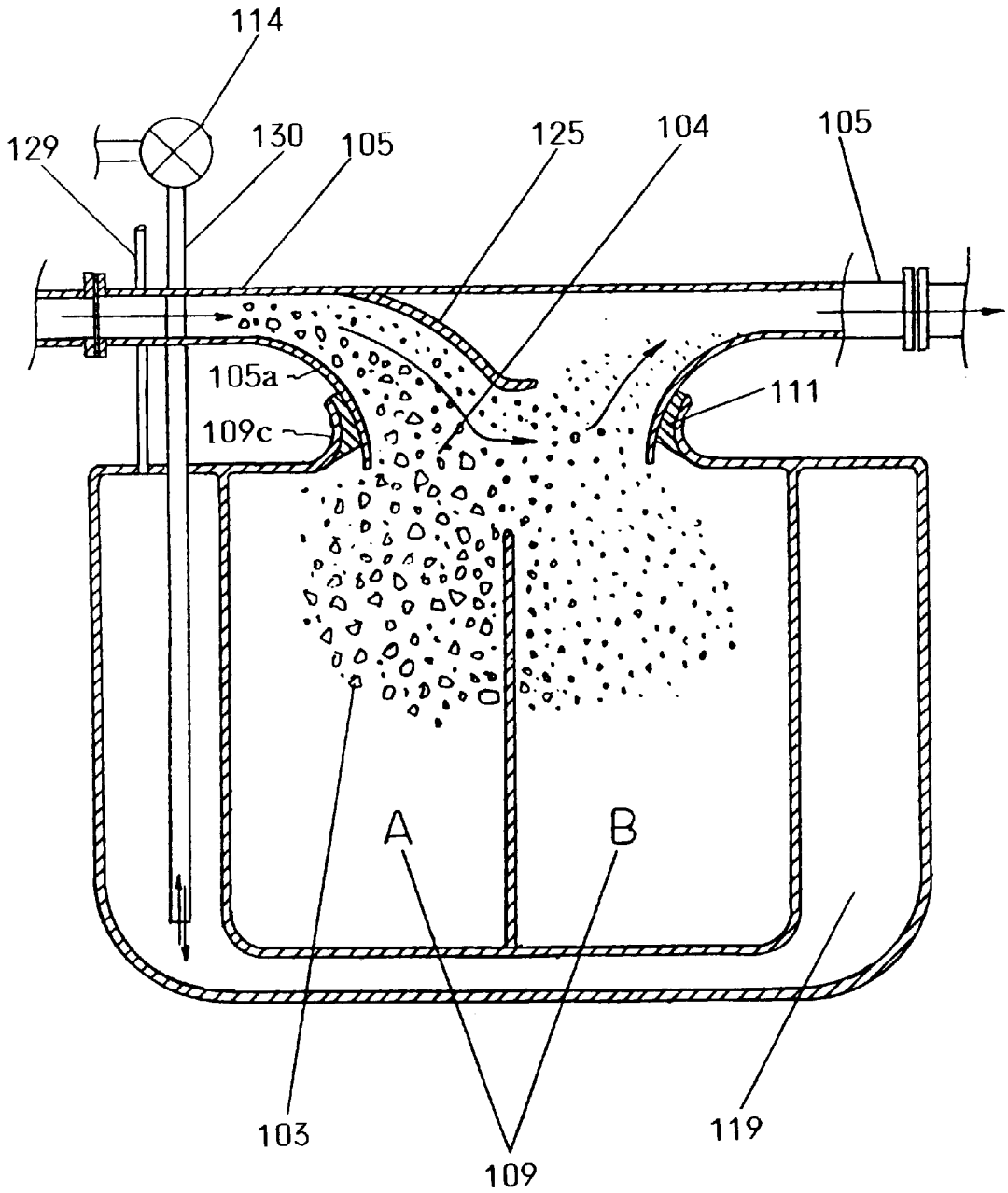
FIG. 6 is an explanation view of a container.

First Embodiment of the present invention is shown in FIGS. 1, 2 and 3.

A symbol 19 stands for a dredging boat. As shown in FIG. 2, a planar shape of the dredging boat 19 is formed into a U-shape. Screws 20 are provided to each rear end of the boat 19, so that the boat 19 is capable of easily linearly moving and turning rightward and leftward.

A symbol 2 stands for a case, an upper part and a middle part thereof are formed into a cylindrical shape and its upper end is opened; a lower part thereof is formed into a pocket portion 21, whose sectional area is broader than that of the middle part, and its lower end is closed. The case 2 is located in an inner space of the U-shaped boat 19, and the upper end thereof is pivotably attached to the boat 19 by a horizontal shaft 1, so that the lower part can be (upwardly and downwardly) moved in the directions shown by arched arrows 26.

A symbol 9 stands for a conveyor for discharging sand and gravel, it is disposed in the case 2 and extended along the longitudinal direction of the case 2, a lower part thereof is located in the pocket portion 21 and an upper part thereof is located close to the opened upper end of the case 2, and sand and gravel (hereinafter referred to as "sand") in the pocket portion 21 can be conveyed to a container 36, which is disposed in the boat 19. A belt conveyor may be employed as the conveyor 9, a type of conveyor is not limited but a bucket type conveyor is preferably employed.

A symbol 12 stands for a drain pump for controlling water level, it is disposed on the boat 19, and water in the pocket portion 21 is drained through a drain pipe 12*a*, which is extended into the pocket portion 21. A space 24 is formed by draining the water in the pocket portion 21. The drained water is introduced into a precipitation tank 18.

There is provided a first float 10 in the lower part of the case 2. An upper part of the float 10 and an upper part of the pocket portion 21 are communicated by a communication pipe 14, so the float is communicated with the atmosphere.

A symbol 13 stands for a pump, it supplies water into and discharges water from the float 10 via a pipe 22, so that buoyant force working on the float 10 and the case 2 can be adjusted. The case 2 can be laid down into the water with optional angle by adjusting the buoyant force, so that sand in shoals and depths can be dredged.

Note that, a symbol 44 stands for a rope for suspending and holding the case 2. The rope 44 is extended a required length from the boat 19.

The case 2 is capable of backwardly inclining with respect to the boat 19. With this structure, the forward movement of the boat 19 is not baffled.

Symbols 3 stand for suction pipes, an upper end of each suction pipe is communicated with an upper part of the pocket portion 21; a lower end thereof is located close to a bottom of the water. With this structure, the case 2 is communicated with the water. By discharging the water in the case 2 by the drain pump 12, level difference between the water level in the case 2 and the external water level is formed, so that the sand is sucked from the suction pipes 3 into the pocket portion 21 by the siphon principle. To maintain the water level in the pocket portion 21, amount of the water drained by the drain pump 12 is greater than that of the sand sucked into the pocket portion 21 from the suction pipes 3. A symbol 28 stands for a level switch, which includes, for example, a magnet float and a pair of lead switches turned on and off by the magnet float(not shown), the drain pump 12 is started when the float is upwardly moved and the upper lead switch is turned on, and the drain pump 12 is stopped when the float is downwardly moved and the lower lead switch is turned on.

A cover member 29, which is horizontally extended to cover over an open end 31, and a guide plate 39, whose front end is slightly curved downward, are provided close to the open ends of the suction pipes 3, which are opened in the pocket portion 21. With this structure, the sand sucked from the suction pipes 3 is horizontally guided by the cover member 29 and the guide plate 39, so that heavy stones fall into a collecting portion 37 where they pile onto the conveyor 9 and are conveyed to the external container 36 by the conveyor 9.

Therefore, the water, which is introduced to a part above the cover member 29 and the guide plate 39 via an outlet 32, includes fine sand only. A opened front end of the drain pipe 12*a* is located in the part above the cover member 29 and the guide plate 39 so as to drain the water in said part.

There is provided a bellows portion 16 in an intermediate part of the case 2, so that the lower end of the suction pipes 3 can be always located close to the bottom of the water even if the inclination angle of the case is changed.

Symbols 6 stand for second floats, which are respectively disposed to the suction pipes 3. Each float 6 is communicated with the pocket portion 21 via a communication pipe 6*a*. So the floats 6 are communicated with the atmosphere, too. The pump 13 supplies water into and discharges water from the floats 6, so that buoyant force working on the floats 6 and the suction pipes 3 can be adjusted. The pump 13 supplies water into and discharges water from the float 10 too, but another pump for supplying water into and discharging water from the second floats 6 may be provided. By the buoyant force working to the suction pipes 3, the suction pipes 3 are prevented from sinking into the bottom of the water by their own weight are capable of easily moving along an uneven surface of the bottom thereof with the movement of the boat 19. Note that, the suction pipes 3 are capable of turning by the floats 6 within an angle shown by an arrow 25.

Dome-shaped covers 4 are respectively disposed at the lower ends of the suction pipes 3 so as to enclose inlets 7. The covers 4 prevent the inlets 7 of the suction pipes 3 from excessively sinking into the bottom of the water.

As shown in FIG. 3, each cover 4 is made of a flexible material, e.g., rubber, and a lower edge 38 thereof can contact the bottom of the water by providing bellows portions 33. There are breaks formed 43*a* in a rear part of the cover so as to form tongue pieces 43, which contact a depression formed on the bottom of the water after dredging. The water enters inner spaces of the covers 4 from a gap between their lower edges and the bottom of the water.

Filters 41, each of which has a star-shaped opening 42, are respectively attached to the inlets 7, which are formed at the lower ends of the suction pipes 3 extended into the covers 4. By the filters 41, the amount of sucking water can be fixed and the inlets 7 are effectively prevented from being filled with sand, cloth, strings, etc.

Electromagnetic solenoids 5 are respectively disposed on the suction pipes 3 and close to the covers 4. Sand 30 on the bottom of the water is dug by digging members 23, which are extended and retracted by the electromagnetic solenoids 5. With this structure, the sand is peeled off from the bottom and can be easily sucked from the inlets 7. Symbols 8 stand for pipes for spouting circulating water, front ends thereof are respectively extended into the covers 4, and supernatant clean water, which has been introduced into the precipitation tank 18 by the pump 11, is spouted, toward the bottom of the water, from the front ends. Since pressurized water is spouted into parts enclosed by the covers 4, the sand layer on the bottom of the water can be properly peeled off, and dredging efficiency can be increased. By reusing the supernatant clean water, amount of the turbid water can be reduced.

While sucking the water, if the percentage of the sand in the sucked water is increased, the pipes are apt to be filled. Symbols 35 stand for holes for adjusting amount of sucking water, which are respectively opened at proper parts of the suction pipes 3, and their sizes can be adjusted by opening and closing lids, not shown, so that the amount of sucking into the pipes can be adjusted and the pipes can be prevented from being filled.

In the present embodiment, as shown in FIG. 2, six suction pipes 6 are attached to one case 2. With this structure, dredging range can be extensive. Even if one of the suction pipes 3 gets fouled on operative, the dredging work can be continued with other suction pipes 3 while checking and repairing the bad pipe 3. Note that, the number of the suction pipes 3 is, of course, not limited.

The dredging apparatus of the present embodiment has the above described constitution.

The dredging work is started to drain the water in the pocket portion 21. Upon draining the water, water and sand are sucked into the case 2 through the suction pipes 3, then the space is gradually formed in the case 2 because the amount of the water drained is greater than that of the water sucked, so that the water level in the pocket portion 21 can be maintained at a prescribed level. The level difference between the water level in the case 2 and the external water level generates great sucking force, so that the sand deposited on the bottom of the water is continuously sucked into the pocket portion 21 together with the water, stones and large gravels are sidewardly guided by the cover member 29 and the guide plate 39 and deposited onto the conveyor 9, then conveyed to the container 36.

By the great sucking force generated by the level difference (the siphon principle), the sand can be introduced into the pocket portion 21, through the suction pipes 3, together with the water, and most of the sand is separated from the water in the pocket portion 21, namely they are separated rapidly and separately drained and conveyed so that fluid resistance and energy loss can be reduced. If the level difference is made greater, the sucking force is also made greater and effective dredging work can be executed.

As described above, inner pressure of the pocket portion 21 is lower, so efficiency of sucking sand can be increased by sinking deeper because the level difference is made greater, further fluid speed is made faster and precipitation distance for separating sand and gravel can be longer. The length of the cover member 29 and the angle of the guide plate 39 are adjusted on the basis of the fluid speed. Experiments were executed in a fluid whose fluid speed was 3 m/sec. and which included 15% of sand and gravels; gravels of about 10 mm (±3 mm) could be separated in a precipitation distance of about 60 cm; sand of about 2 mm could be separated in a precipitation distance of about 85 cm; and sand of about 1 mm could be separated in a precipitation distance of about 110 cm. other fine sand floated in the water and horizontally moved as the turbid water.

As described above, the inclination angle of the case 2 and the suction pipes 3 can be controlled by adjusting the buoyant forces working on the first float 10 and the second floats 6, which depend on the amount of the water in the floats, and the inlets 7 of the suction pipes 3 can always be located close to the bottom of the water because the suction pipes 3 are flexible, so that the dredging work can be continuously and effectively executed with the movement of the boat 19. Since the distance between the inlets 7 and the bottom of the water can be fixedly maintained, density of the fluid (amount of sand with respect to amount of water) can be nearly uniform, the suction pipes 3 from being prevented to be filled, and draining of a large amount of turbid water can be prevented. By spouting the supernatant water of the precipitation tank 18 into the covers 4, sand layers can be effectively separated and turbid water to be drained outside can be reduced.

Second Embodiment

Second Embodiment will be explained with reference to FIGS. 4–8.

A symbol 101 stands for a dredging boat.

A symbol 102 stands for a case, which is downwardly extended from the boat 101 so as to sink a whole body thereof, except an upper end, into water.

An upper part of the case 102 is formed into a cylindrical shape, whose upper end is opened; a lower part thereof is formed into a pocket portion 102*a*, whose diameter is greater than that of the cylindrical upper part.

A symbol 109 stands for a container, which has a double wall structure, which is located under the boat 101 and in the water, and which is attached to the boat 101 by a holding member 109*a*. The holding member 109*a* and the container 109 are connected by proper fixing means, e.g., bolts.

An inner chamber of the container 109 is divided into a chamber "A" and a chamber "B" by a partition 109*b*. There is formed a connecting wall 109*c* along an open edge of the inner chamber.

A symbol 105 stands for a suction pipe, one end thereof is communicated with the pocket portion 102*a*; the other end thereof is opened in the water as an inlet 106. A middle part of the suction pipe 105 is partially opened, the inner diameter of the open part is gradually increased toward a lower end, and an introduction wall 105*a* is attached to or extended from an edge of the open part.

When the container 109 is connected to the holding member 109*a*, a seal member 111, which is made of rubber or a plastic, is filled into a gap between 'the connecting wall 109*c* and a lower end of the introduction wall 105*a* so as to prevent sand, etc. from invading the gap. By the seal member, the gap between the container 109 and the introduction wall 105*a* is closed water tight. While dredging sand and gravels, inner pressure of the container 109 becomes negative, so that great water pressure works to to more tightly close the gap.

A symbol 125 stands for a guide plate, which is located in the open part above the container 109 and which is slightly downwardly extended from an opening section 104, which is opened in a left part of the suction pipe 105 connected to the inlet 106, toward the partition 109*b*.

In the present embodiment, a plurality of the suction pipes 105, which are respectively connected to the inlets 106, are connected to the introduction wall 105*a* so as to dredge a wide area. Note that, the number of the suction pipes 105 is not limited.

Vertical vibration of the container 109 badly influences the suction pipes 105, so flexible portions 112, e.g., bellows portions, are partially formed in the suction pipes 105 to absorb the vibration.

A symbol stands for a drain pump for draining the water in the case 102 through a drain pipe 117, which is extended in the cylindrical part of the case 102. The drained water is introduced into a precipitation tank 121.

By draining the water in the case 102, the water level in the case 102 goes down, so that a level difference between the water level in the case 102 and the external water level is formed. By forming difference in level sand and water are sucked into the inlets 106 and introduced into the container 109 as well as the former embodiment.

While sucking the sand and water, large or heavy gravels, etc. are introduced into the chamber "A"; small or light gravels, etc. are introduced into the chamber "B". The water including fine sand is introduced into the case 102 via the suction pipe 105, and further introduced into the precipitation tank 121 by the drain pump 124, then the fine sand deposits in the precipitation tank 121.

A symbol 120 stands for a level switch, which is capable of sensing the water level in the case, as well as the former embodiment, so as to control the drain pump 124 and maintain the water level in the case 102.

An outer chamber 119 of the container 102 acts as a float. The float 119 is communicated with the atmosphere via a pipe 129. A symbol 114 stands for a pump for supplying water into and discharging water from the float 119 so as to adjust buoyant force working a the float 119. Namely, the buoyant force can be adjusted, according to weight of the deposited gravels in the chambers "A" and "B", by supplying water into or discharging water from the float 119.

Dome-shaped covers 115 respectively cover over the inlets 106 of the suction pipe 105 as in the former embodiment. Namely, the suction pipes 105 are respectively pierced through top portions of the dome-shaped covers 115, so that open ends of the inlets 106 are located close to the bottom of the water.

A symbol 116 stands for a contact plate, which is located slightly below each inlet 106, and which is arranged perpendicular to each suction pipe 105 and connected to the suction pipe 105 by arms 108. One end of each arm 108 is fixed to an adjustable ring 106*b* through which the suction pipe 105 is pierced, and the ring 106*b* is fixed to the suction pipe 105 by a bolt (not shown). By loosening the bolt and moving the ring 106*b* on the suction pipe 105, the distance between the contact plate 116 and the inlet 106 can be adjusted.

Each contact plate 116 has a suction hole 118, which is is opened at a position corresponding to the inlet 106. Gravels are mainly sucked into the inlet 106 from the suction hole 118; water including sand is sucked thereinto from a gap between an upper face of the contact plate 116 and the lower end of the suction pipe 105. Therefore, the percentage of the sand and gravels in the water can be adjusted by adjusting the gap between the contact plate 11 and the inlet 106.

An outer edge 126 of the contact plate 126 is upwardly bent so as to smoothly move on the bottom of the water. An outer diameter of the contact plate 116 is shorter than a inner diameter of the lower end of the cover 115, so there is formed a gap between the lower end of the cover 115 and an outer edge of the contact plate 116.

A plurality of sharp projections 123 are disposed in a bottom face of the contact plate 116. On the other hand, a vibrator 122 is disposed on an upper face of the contact plate 116. By operating the vibrator 122, the contact plate 116 is vibrated and the vibration is transmitted to the projections 123. The sand 103 on the bottom of the water is dug and the sand dug is sucked into the suction hole 118. Namely, the vibration makes gaps in the solidified sand, water percolates into the gaps, and then the sand is peeled off by buoyant force and the stream of the water. In comparison with a method of agitating the sand, the present method employing the vibration of the projections 123 is capable of preventing creation of turbid water.

In the precipitation tank 121, sand, etc. in the water precipitate into the bottom of the precipitation tank 121, then the water is introduced by pipes 107 and spouted into the covers 115. Further, the water is spouted toward the bottom of the water via gaps between the lower ends of the covers 115 and the outer edges of the contact plates 116. The sand which has been dug by the projections 123 is peeled off from the bottom of the water by the spouted water and sucked into the suction holes 118. By reusing the water, which was once drained as turbid water, for dredging sand, diffusion of the turbid water can be prevented, so this method is advantageous.

Preferably, floats 128 are respectively attached to the suction pipes 105 to which the inlets 106 are opened. Each float 128 is communicated with the atmosphere by a pipe 129, and water therein is supplied and drained by a pump 127 via a pipe 130. With this structure, buoyant forces working on the floats 128 and the suction pipes 105, to which the covers 115 and contact plates 116 are respectively attached, can be adjusted, so that the up-down movement of the suction pipes 105 can be easily executed and contact force of the contact plates 116, which press the bottom of the water, can be flexibly adjusted. By balancing the weight of the contact plates 116 with the buoyant force, the contact plates 116 are capable of easily following the movement of the boat 101.

A symbol 110 is a rope for suspending the suction pipe 105 having the inlet 105 and maintaining the location of the contact plate 116.

Note that, bellows portions 112 and 113 are flexible portions at which the suction pipes 105 and spout pipes 107 can be bent. The spout and pipes 107, suction pipes 105, pipes 129 and 130 are capable of extending and retracting according to the depth of the water.

The dredging apparatus of the Second Embodiment has above described constitution.

The dredging work is started by sinking the contact plates 116 until reaching the bottom of the water and operating the drain pump 124. The amount of the water which is drained from the case 102 by the drain pump 124 is greater than that of the water which is introduced into the pocket portion 102*a* via the suction pipes 105. Therefore, the water level in the case 102 gradually descends, and the water level is maintained by the level switch 120. The sand on the bottom of the water is powerfully sucked into the inlets 106 by the siphon principle based on the level difference between the water level in the case 102 and the external water level as well as the former embodiment.

As described above, the sand is dug by the projections 123, effectively peeled off from the bottom by the water spouted from the spout pipes 107 and sucked into the inlets 106.

The sand and water sucked into the inlets 106 are introduced into the container 109 via relative short paths. The sand which has been sidewardly (horizontally) introduced from the opening section 104 of the suction pipe 105 is guided by the guide plate 125, so that relatively large gravels are deposited in the chamber "A"; small gravels are deposited in the chamber "B". The water including fine sand is introduced into the pocket portion 102*a* via an upper part of the chamber "B" and the suction pipe 105, then introduced into the precipitation tank 121 by the drain pump 124. Fine sand is deposited in the precipitation tank 121, then the water is spouted into the covers 115 via the spout pipes 107.

In the case of dredging a shoal, the boat is anchored in an offing, the case 102 is laid down into a deep water so as to form the level difference, and the suction pipes 105 are extended until reaching the shoal so as to dredge.

The sand and gravels are gradually deposited in the container 109 and the weight is made heavier, thus the buoyant force caused by the float 119 is adjusted so as to reduce load working to the connecting member, etc. of the container 109. When the container 109 is complete filled, the dredging work is stopped, and the container 109 is cut off from the boat 101. At that time, the buoyant force of the float 119 works on the container 109, so the container 109 can float on the water surface and can be conveyed by a small tug boat or with a rope.

After that, a new container 109 is disposed to the boat 101, and the dredging work is started again.

Figure 7:
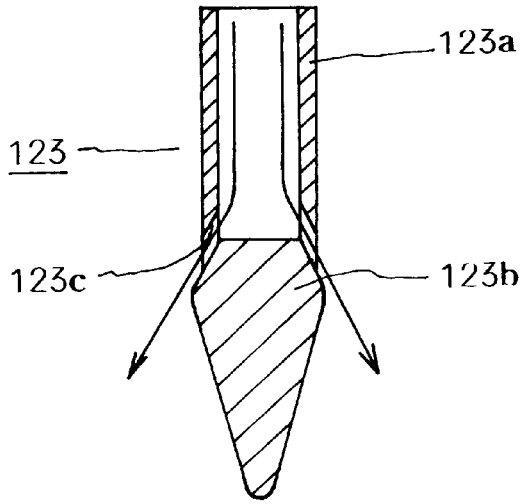
FIG. 7 is a sectional explanation view of a projection of another example.

Another example of the projection 123 will be explained with reference to FIG. 7.

The projection 123 comprises: a cylindrical portion 123*a* which is attached to the contact plate 116 and whose upper end is opened in the upper face of the contact plate 116; and a sharp head portion 123*b* which is attached to a lower end of the cylindrical portion 123*a*. There is formed a spouting hole 123*c*, which is headed downwardly, in a connecting portion in which the cylindrical portion 123*a* and the head portion 123*b* are connected.

With this projection 123, the water introduced into the cover 115 is spouted toward the bottom of the water from the projections 123 too, so that the sand can be more effectively peeled off from the bottom. Note that, a preferred spout angle of the water spouted from the spout hole 123*c* is 45° or less with respect to an axis line of the cylindrical portion 123*a*; at these angles the water can be powerfully spouted toward the bottom of the water. Preferably, the maximum diameter of the head portion 123*b* is greater than the outer diameter of the cylindrical portion 123*b* so as to prevent the projection hole 123*c* from filling.

Figure 8:
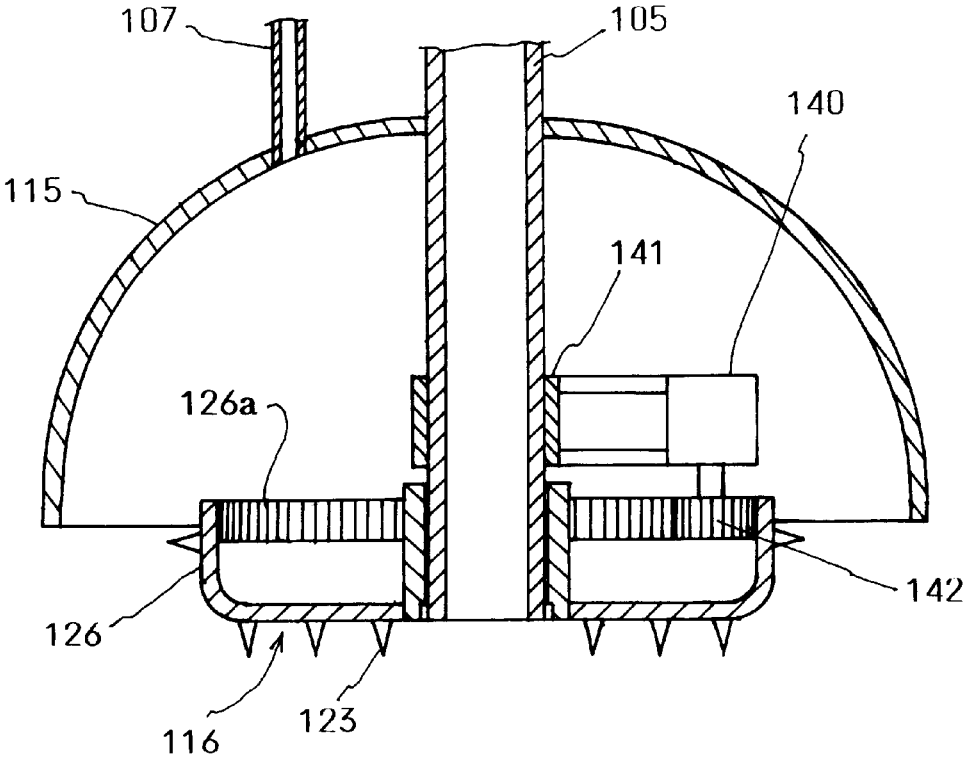
FIG. 8 is an explanation view of the contact plate of another example.

Another example of the contact plate 116 will be explained with reference to FIG. 8.

In this example, the contact plate 116 is provided on the lower end of the suction pipe 105 and capable of rotating about an axial line of the suction pipe 105. The projections 123 are disposed on the outer face of the contact plate 116.

There is provided an internal gear 126*a* on an inner circumferential face of a side wall 126, which is upwardly extended from an outer edge of the contact plate 116. A motor 140 is attached to the suction pipe 105 by a connecting member 141, and a gear 142, which is fixed to a rotary shaft of the motor 140, is engaged with the internal gear 126*a*, so that the contact plate 116 can be rotated.

By employing this example, the contact plate 116 is rotated, so that the bottom of the water is effectively dug and the dredging efficiency can be increased. The vibrator 122 is not required.

What is claimed is:

1. A method of dredging sand and gravels in a dredging apparatus including, a case being laid down into water in communication with the atmosphere;

a suction pipe having a suction portion at a lower end thereof, said suction pipe being connected to said case;

a dome-shaped cover being provided to the lower end of said suction pipe so as to cover over the suction portion;

a spout pipe whose one end is opened in said dome-shaped cover;

a spout pump for spouting water, with high pressure, from said spout pipe toward a bottom of water;

a drain pump for draining water in said case; and a container being removably disposed at an intermediate portion, of said suction pipe, said method comprising the steps of:

spouting water, with high pressure, from said spout pipe toward the bottom of the water by said spout pump;

draining water in said case so as to form a space therein and to form a level difference between a water level in said case and an external water level; and sucking the sand and gravels from said suction pipe into said container by a water current caused by the level difference.

2. The method according to claim 1, wherein a portion of turbid water drained from said case is spouted, with high pressure, from said spout pipe toward the bottom of the water by said spout pump.

3. The method according to claim 2, wherein said dredging apparatus further includes a precipitation tank in which the turbid water is reservoired and a part of the turbid water reservoired in said precipitation tank is spouted, with high pressure, from said spout pipe toward the bottom of the water by said spout pump.

4. A dredging apparatus comprising a case being laid down into a body of water in communication with the atmosphere;

a suction pipe having a suction portion at a lower end thereof, said suction pipe being connected to said case;

a dome-shaped cover being provided to the lower end of said suction pipe so as to cover the suction portion:

a spout pipe whose one end is opened in said dome-shaped cover;

a spout pump for spouting water, with high pressure, from said spout pipe toward a bottom of said body of water;

a drain pump for draining water in said case and forming a level difference between a water level in said case and an external water level; and a container being removably disposed at an intermediate portion of said suction pipe.

5. The dredging apparatus according to claim 4, further comprising: a precipitation tank in which the turbid water is reservoired, and wherein a part of the turbid water reservoired in said precipitation tank is spouted, with high pressure, from said spout pipe toward the bottom of water by said spout pump.

6. The dredging apparatus according to claim 4, further comprising:

a first float being provided to said suction pipe and in communication with the atmosphere; and a first pump for supplying water into and draining water from said first float so as to adjust a buoyant force of said float.

7. The dredging apparatus according to claim 4, further comprising:

a second float being provided to said container and in communication with the atmosphere; and a second pump for supplying water into and draining water from said second float so as to adjust a buoyant force of said second float.

8. The dredging apparatus according to claim 4, further comprising:

a first float being provided to said suction pipe and in communication with the atmosphere;

a first pump for supplying water into and draining water from said first float so as to adjust a buoyant force of said first float;

a second float being provided to said container and in communication with the atmosphere; and a second pump for supplying water into and draining water from said second float so as to a adjust buoyant force of said second float.

9. The dredging apparatus according to claim 4, further comprising:

a contact plate having a suction hole, said contact plate being provided to said suction pipe so as to cover over a lower part of the suction portion.

10. The dredging apparatus according to claim 9, wherein said contact plate has a pile shaped projection which is capable of piercing the bottom of the body of the water.

11. The dredging apparatus according to claim 10, wherein said pile-shaped projection has a communication path which communicates a space above said contact plate with a space under said contact plate.

12. The dredging apparatus according to claim 9, further comprising:

a vibrator for vibrating said contact plate.

13. The dredging apparatus according to claim 9, wherein said contact plate is capable of rotating about an axis of said suction pipe, and wherein said contact plate is rotated by a motor.

14. A dredging apparatus comprising:

a cylindrical case pivotably connected to a boat on a body of water so as to allow an up-down movement of said cylindrical case, said case having an upper end, which is opened and in communication with the atmosphere, and a lower end which is closed and laid down into said body of water;

a suction pipe having an inlet at the lower end thereof, said suction pipe being connected to said case;

a dome-shaped cover being provided to the lower end of said suction pipe so as to cover the suction portion;

a spout pipe whose one end is opened in said dome-shaped cover;

a spout pump for spouting water, with high pressure, from said spout pipe toward a bottom of said body of water;

a drain pump for draining water in said case and forming a level difference between a water level in said case and an external water level; and a conveyor extended in said case, said conveyor discharging sand and gravels deposited in said case.

15. The dredging apparatus according to claim 14, further comprising:

a precipitation tank in which the turbid water is reservoired, and wherein a part of the turbid water reservoired in said precipitation tank is spouted, with high pressure, from said spout pipe toward the bottom of said body of water by said spout pump.

16. The dredging apparatus according to claim 14, wherein said case has a pocket portion whose sectional area is broader than a sectional area of an intermediate portion of said case at the lower end thereof, and wherein said suction pipe is connected to said pocket portion.

17. The dredging apparatus according to claim 16, further comprising:

a guide plate provided in said pocket portion and capable of introducing the sand and gravels, which are sucked by said suction pipe, sideward.

18. The dredging apparatus according to claim 16, wherein a rear part of said boat is divided into two divided sections, said case is pivotably connected between said two divided sections so as to allow the up-down movement thereof, and at least one propelling screw is respectively provided to said two divided sections.

19. The dredging apparatus according to claim 16, further comprising:

a first float being provided to said case and in communication with the atmosphere; and a first pump for supplying water into and draining water from said first float so as to adjust a buoyant force of said first float.

20. The dredging apparatus according to claim 14, further comprising:

a second float being provided to said suction pipe and in communication with the atmosphere; and a second pump for supplying water into and draining water from said second float so as to adjust a buoyant force of said second float.

* * * * *